US010646023B2

(12) United States Patent
Meillan

(10) Patent No.: US 10,646,023 B2
(45) Date of Patent: May 12, 2020

(54) HAMMOCK, ESPECIALLY SUITABLE FOR CHILDREN AND FOR THERAPY PURPOSES

(71) Applicant: La Siesta GmbH, Jugenheim (DE)

(72) Inventor: Jean-Christophe Meillan, Ingelheim (DE)

(73) Assignee: LA SIESTA GMBH, Jugenheim (DE)

( * ) Notice: Subject to any disclaimer, the term of this patent is extended or adjusted under 35 U.S.C. 154(b) by 0 days.

(21) Appl. No.: 15/489,106

(22) Filed: Apr. 17, 2017

(65) Prior Publication Data

US 2017/0295912 A1 Oct. 19, 2017

(30) Foreign Application Priority Data

Apr. 19, 2016 (DE) ..... 20 2016 102 049 U

(51) Int. Cl.
*A45F 3/22* (2006.01)
*A47D 7/04* (2006.01)
*A47C 17/84* (2006.01)

(52) U.S. Cl.
CPC ..... *A45F 3/22* (2013.01); *A47D 7/04* (2013.01); *A47C 17/84* (2013.01)

(58) Field of Classification Search
CPC ..... A47D 7/04; A45F 3/22; A47C 17/84
See application file for complete search history.

(56) References Cited

U.S. PATENT DOCUMENTS 276,234 A * 4/1883 Fichtner ..... A45F 3/22 5/122
350,878 A * 10/1886 Fox ..... A45F 3/22 5/120
466,013 A * 12/1891 Stiles ..... A45F 3/22 5/122
483,753 A * 10/1892 Washburn ..... A45F 3/22 5/120
751,907 A * 2/1904 Furst ..... A45F 3/22 5/122
2,694,208 A 11/1954 Christensen
4,071,917 A * 2/1978 Mojica ..... A45F 3/22 135/90
4,162,550 A 7/1979 Willingham
RE33,232 E * 6/1990 Fausett ..... A45F 3/22 211/87.01
5,038,428 A * 8/1991 Shur ..... A45F 3/22 5/122
5,113,537 A * 5/1992 Turk ..... A45F 3/22 135/90

(Continued)

FOREIGN PATENT DOCUMENTS

DE 20114407 1/2002
DE 202014103523 10/2014
EP 1447022 8/2004

*Primary Examiner* — Robert G Santos
*Assistant Examiner* — Rahib T Zaman
(74) *Attorney, Agent, or Firm* — Hauptman Ham, LLP

(57) ABSTRACT

A hammock consisting of a reclining surface and two opposite tapering ends. Each end leading to a suspension, wherein the base surface of the hammock is fashioned as an open ellipse with pointed converging ends in the form of end pieces. The reclining surface comprises a roughly rectangular middle region, which is stitched at both transverse edges each time to an edge of a roughly triangular or circular segment shaped end piece, which leads to a suspension at its free, pointed end.

11 Claims, 3 Drawing Sheets

(56) References Cited

U.S. PATENT DOCUMENTS

Figure 1:
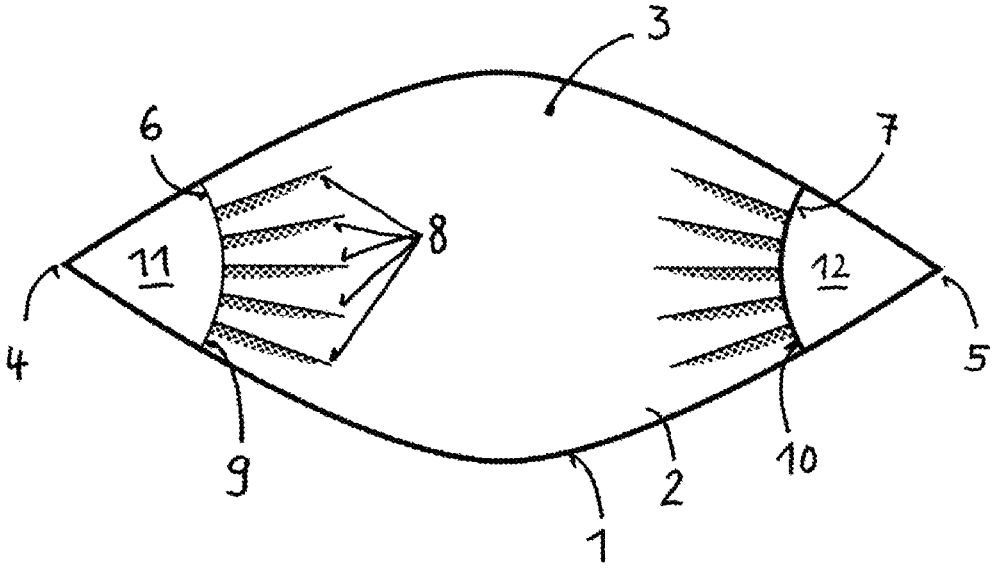

| | | | | | |
|---|---|---|---|---|---|
| 5,307,526 | A * | 5/1994 | Appleby | A47K 11/00 | 4/460 |
| 5,673,444 | A * | 10/1997 | Middendorf | A45F 3/24 | 5/120 |
| 6,701,549 | B1 * | 3/2004 | Eriksen | A45F 3/22 | 5/120 |
| 7,020,915 | B1 * | 4/2006 | Helsdon | A45F 3/22 | 5/121 |
| 9,072,367 | B2 * | 7/2015 | Kramer | A45F 3/22 | |
| 9,265,329 | B1 * | 2/2016 | Kullenburg | A45F 3/24 | |
| 2003/0196265 | A1 * | 10/2003 | Hennessy | A45F 3/22 | 5/120 |
| 2016/0029776 | A1 | 2/2016 | Kullenberg | | |
| 2018/0079830 | A1 | 3/2018 | Waddy | | |

* cited by examiner

HAMMOCK, ESPECIALLY SUITABLE FOR CHILDREN AND FOR THERAPY PURPOSES

The invention concerns a hammock, especially suitable for children and for therapy purposes, according to the preamble of claim 1.

Classical hammocks consist of a rectangular reclining surface, preferably made of a stable, tear-proof fabric or netting, as well as lateral cords, emerging from the reclining surface at both ends, which are joined into a suspension loop, and hung slightly drooping from two lateral suspension points at relatively large distance from each other.

An alternative to this traditional type of hammock is the so-called travel hammock, consisting of a rectangular reclining surface, preferably made from very light fabric, and likewise hung slightly drooping from two lateral suspension points at relatively large distance from each other. By contrast with traditional hammocks, however, travel hammocks have no cords emerging at the two ends. Instead, encircling eyelets or sewn-on loops or drawstrings are formed on at least two opposite edges of the reclining surface, through which rope or belt-like suspensions are led, forming suspension loops. The fabric in the area of the eyelets, cords, or drawstrings is strongly pulled together, thereby forming the typical slightly drooping hammock shape.

However, the materials for classical hammocks are generally much stronger and thicker, so that this form of suspension in the nature of travel hammocks without cords is generally of no interest. Stable, heavy hammocks without cords are therefore not common and this form in the nature of a travel hammock is usually confined to small-format classical hammocks, because this design has strongly bulging thickenings at both ends, especially in the case of larger hammocks, and a very large piling up of fabric at the ends and along the edges, which a user can hardly grasp, or cannot grasp at all, and which makes the hanging up of such a hammock quite difficult.

However, the cords customarily used with classical hammocks are a hindrance in many applications. They have a tendency to get tangled and knotted when a hammock is frequently put up and taken down or washed. They are one of the most common reasons for repair work to hammocks, for example when they have been ripped out or damaged by children. If not handled properly, body parts, especially those of children, can get caught in the cords.

Furthermore, the cords often consist of a different material from the fabric of the reclining surface and have a different processing and treatment, which increases the complexity of the logistics and manufacturing of a classical hammock. Therefore, doing away with the classical cords has a number of benefits.

High-quality hammocks of the classical design with cords, however, are distinguished in particular in that they are always perceived by the user as being balanced and comfortable, regardless of the distances of the hanging and the sitting or reclining position. Well-made large hammocks even allow a comfortable use by two or more persons at the same time. When used properly, they are secure against overturning.

Finally, yet another alternative hammock design is known with a nonrectangular, but still "hammock-like" cut of the fabric of the reclining surface without cords. These somewhat "mattress-style" hammocks, often with a spreading construction integrated in the entire reclining surface and oftentimes in addition coming with a special hammock stand of a particular dimensioning, are able to assume a precisely defined and predetermined shape to ensure a comfortable and secure lying without the use of wires. Flexible distances between the suspension points cannot be selected. These special hammocks hang in predetermined position in a nearly flat horizontal plane and are preferably usable only in a straight, extended position, parallel to the reclining surface, such as for sunbathing by one or at most two persons. Getting onto and off of this nonflexible type of hammock is difficult, since the flat, mattress-like reclining surface easily tips over, on which account such hammocks are ill suited for children or the elderly.

In general, however, hammocks are not just used for resting.

It has already been known for many years that for example persons whose perception and motion development needs to be encouraged and trained can be treated by the specific use of hammocks in the course of an ergotherapy or physiotherapy.

Classical hammocks with cords are customarily used for this, preferably with a reclining surface made of fabric, rather than netting. However, in the therapy field, hammocks are generally not hung slightly drooping as usual from two lateral suspension points at relatively far distance from each other. In therapeutic use, hammocks are usually hung in swing fashion from one or two suspension points situated above the reclining surface, e.g., on the ceiling, so that in addition to linear and sideways swinging, rotary movements and swinging in several planes are possible, while the patient is sitting or lying in the hammock.

For easier getting onto the hammock and for special therapeutic exercises, therapy accessories and aids can be inserted in the swing-hung therapy hammock, such as a small mattress or bolster. Without such additional inserts, many exercises are difficult to perform in the therapy hammock, if at all, so that these supplemental inserts usually need to be purchased in addition in the therapy field.

Moreover, not every classical hammock is also suitable for use in the therapy field, since there are heightened demands on the fabric quality here. Basically, for example, the longitudinal edges of a customary hammock constitute a weak point, since these areas are always more greatly strained by getting onto and off from the hammock than the central reclining surface, especially when a person is sitting in the hammock and lets their legs hang down at the side. In the case of therapy hammocks the patients are usually lying across the reclining surface, so that the longitudinal edges are especially strongly and frequently strained.

Therefore, the problem which the present invention proposes to solve is to create a new kind of hammock without cords tapering toward the ends, suitable both for lying and resting in and also for use in the therapy field, and which also in enables an easier getting onto and off from, especially for children and the elderly, with overall better safety. In particular, the lying comfort should be always objectively ensured regardless of the type of suspension.

This is accomplished by a new kind of hammock with the features of claim 1.

Other advantageous embodiments are defined below in the subclaims.

The hammock according to the invention solves the stated problem by an inventive design of the reclining surface, wherein the base surface of the hammock is fashioned overall as an open ellipse with pointed converging ends, the reclining surface consisting of a roughly rectangular middle region, which is stitched at both transverse edges each time to the edge or arc edge of a roughly triangular or circular segment shaped end piece, which leads to a suspension at its free, pointed end.

There are several challenges in the design of a new kind of hammock without cords, due to the importance of the cords combined with the reclining surface for the comfort, balance, and flexibility of a hammock.

Thanks to the hammock according to the invention it is possible by a novel fabric cutting of the reclining surface to replace these familiar cords with fabric and to design the connection of the different materials to each other so that it successfully takes on and fulfills the role of the cords as a balancing element for different suspension variants and reclining positions.

Like traditional high-quality classical hammocks, this new hammock according to the invention, which can be made in different sizes, is characterized by:

high reclining comfort in various reclining positions
uniform weight distribution in the hammock,
great flexibility in regard to the suspension points,
long life due to reduced tearing, and
a comfortable use by several persons at the same time.

In addition, the novel hammock tailoring according to the invention provides substantial benefits with the unification of materials and work steps during the hammock production,
enhanced safety and firm construction for use by children,
use in the therapy field,
use by the elderly, as well as
use by persons with physical and/or mental impairments.

Figure 2:
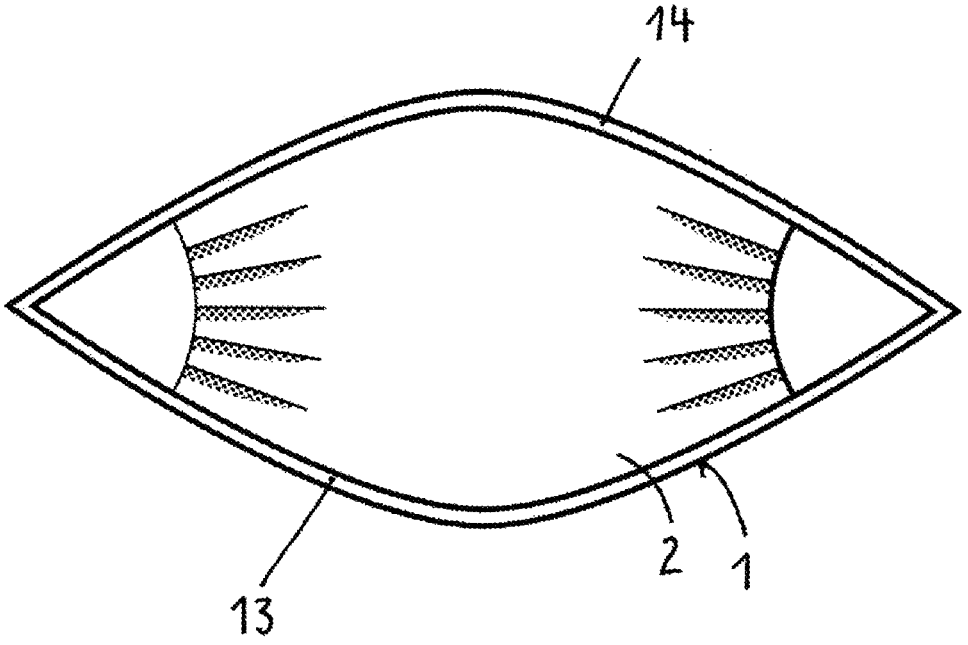
Figure 3:
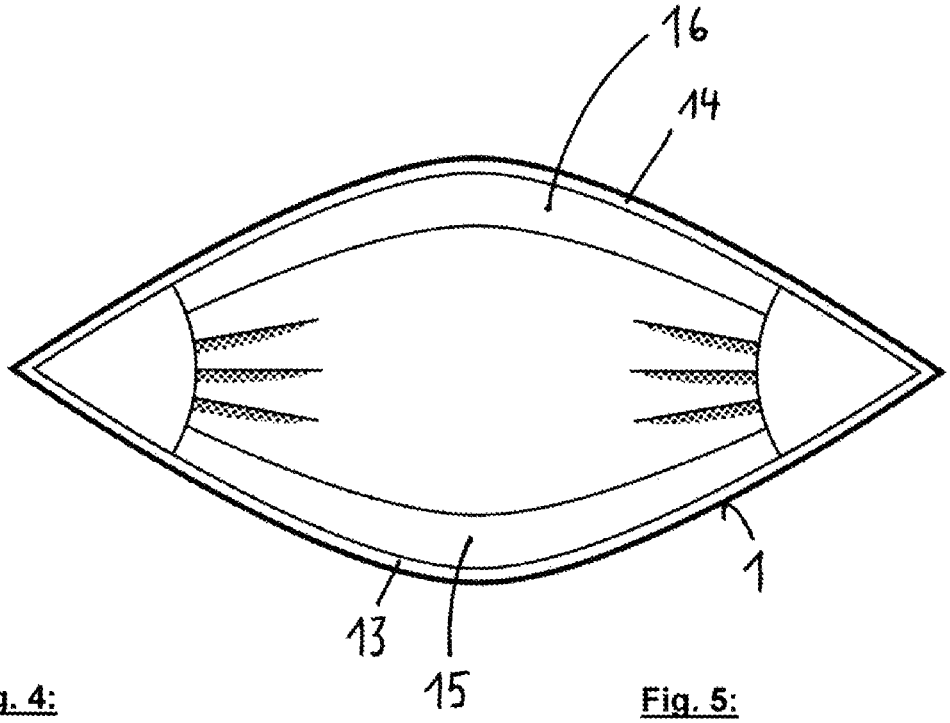
Figure 4:
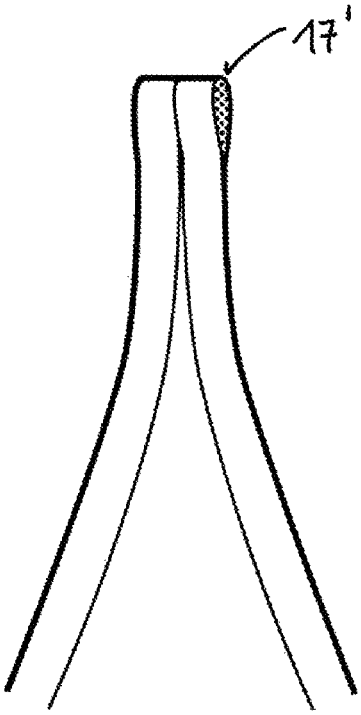
Figure 5:
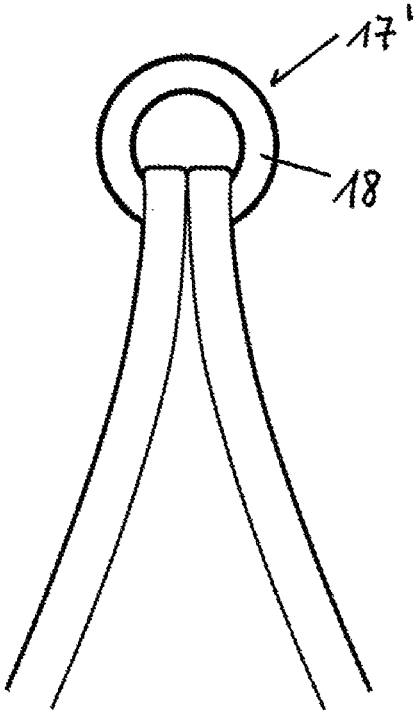
Figure 6:
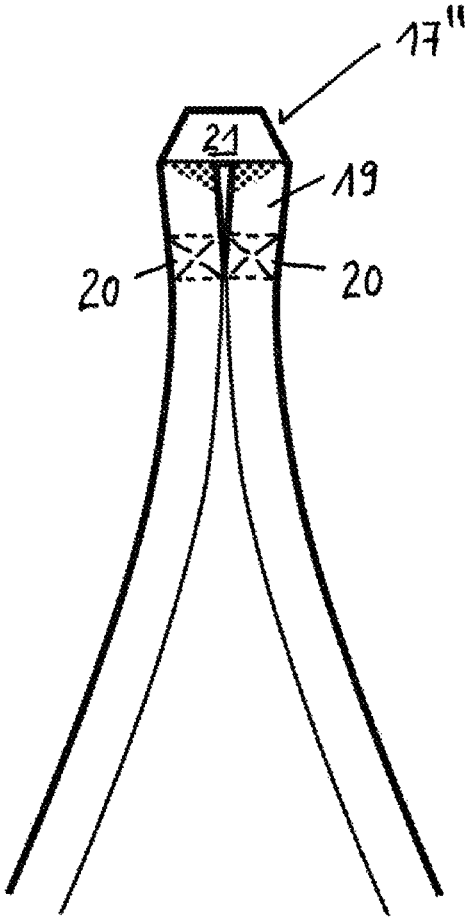

FIGS. 1-5 show various designs of the hammock according to the invention in reduced-scale, stylized representation. There are shown FIG. 1 a top view of the hammock 1 according to the invention in a basic design;

FIG. 2 a top view of the hammock 1 according to the invention in an alternative design;

FIG. 3 a top view of the hammock 1 according to the invention in another alternative design;

FIG. 4 a top view of a loop bow 17 of the hammock 1 according to the invention in one design arranged running transversely to the plane of the reclining surface 2;

FIG. 5 a top view of a loop bow 17 with suspension ring 18 of the hammock 1 according to the invention in one design arranged running transversely to the plane of the reclining surface 2;

FIG. 6 a top view of a loop bow 17 of the hammock 1 according to the invention in an alternative design arranged running in the plane of the reclining surface 2;

FIG. 1 shows the hammock 1 according to the invention with a reclining surface 2 made of a roughly rectangular middle piece 3, which is advantageously laid in flat folds 8 roughly in the style of a pleated fabric at the transverse edges 6, 7 pointing toward the two suspensions 4, 5 and stitched at the transverse edges 6, 7 to an arc edge 9, 10 of a roughly circular segment shaped end piece 11, 12, which leads at its pointed free end lying opposite the arc edge 9, 10 to a suspension 4, 5 not shown here.

Thanks to this configuration, when lying in the hammock 1 according to the invention no traction or compression points detrimental to the comfort are produced in the area of the reclining surface 2, regardless of the distance of the two suspensions 4, 5 from each other.

FIG. 2 shows an advantageous configuration of the hammock 1 according to the invention in which the two longitudinal edges 13, 14 of the reclining surface 2 are strengthened and upholstered.

In this way, the wear-sensitive longitudinal edges 13, 14 are significantly strengthened, especially when getting into or out of the hammock 1 according to the invention, and the lying comfort as a whole is improved, since even a lying transversely to the reclining surface 2 is much more comfortable.

FIG. 3 shows another advantageous design of the hammock 1 according to the invention, in which a much broader reinforced and upholstered margin area 15, 16 is formed along the two longitudinal edges 13, 14 at the margin.

In a special configuration, not shown visually, heavily upholstered margin areas 15, 16 can replace an additional cushion.

Thanks to these optically and texturally distinguished longitudinal edges 13, 14 of the hammock according to the invention from the middle piece 3 of the reclining surface 2, for example by being upholstered margin areas 15, 16, this design is much more easy to handle, especially for children or visually impaired persons, because the getting in and out of the hammock is significantly easier or assisted and the hands are as it were led "blindly" to the longitudinal edges 13, 14 at the sides. Also when lying in the hammock 1 the end of the reclining surface 2 is always clearly distinguishable, which improves the sense of safety of the user.

Furthermore, thanks to the novel design with a plurality of folds 8 stitched to the transitions to the end pieces 11, 12 and thanks to the strengthened longitudinal edges 13, 14 and upholstered margin areas 15, 16, the hammock 1 according to the invention spreads out advantageously and separates into strengthened or upholstered, roughly horizontally lying longitudinal edges or margin areas 13 to 16 and an inner, slightly drooping middle region 3 folded at the transverse edges.

When a patient during therapeutic exercises is lying stretched out on their stomach, face down, or lying across the reclining surface in a classical hammock, the edges of traditional hammocks may result in pressure pain at the armpits, for example if throwing exercises are performed from this position.

However, the strengthened and/or upholstered longitudinal edges and margin areas 13 to 16 of the hammock 1 according to the invention allow the patient full freedom of motion and lying, and at the same time prevent uncomfortable rubbing or pressure pain on the chest or arms.

Another expedient design of the hammock 1 according to the invention, not shown, calls for the reclining surface in the case of a swing-like suspension of the hammock 1 to be at least partly closable like a cavity by means of closure means arranged on the reclining surface 2, thanks to the large amount of fabric at the side.

This produces an additional benefit when the hammock 1 is used as a cavity, for example, for children and persons who have an increased need for withdrawal.

Another design, depicted in FIG. 4, calls for the two end suspensions 4, 5 at the tapering ends of the end pieces 11, 12 to be designed as loop bows 17' and to be arranged rotated to the plane of the reclining surface 2, for example by an angle of around 90°.

In this arrangement, further elements serving for the suspension, such as ropes led through the loop bows 17' or also a suspension ring 18, as shown in FIG. 5, can be arranged in turn extending in the plane of the reclining surface 2.

In the advantageous design per FIG. 5, the two ends of the hammock lead to a ring around which the fabric is laid flush and permanently secured.

In another alternative embodiment per FIG. 6, the loop bows 17" have the same plane as the reclining surface at both ends. According to the invention, this loop bow 17" is formed here from a band 19, whose two free ends 20 are stitched roughly parallel to each other and with the same top side to the tapering end of the end pieces 11, 12. This produces a spreading of the loop bow 17" in the plane of the reclining surface 2 as well as a pocket-like overlap of the center region 21 of the band 19, causing a planar lie of this center region 21 for a suspension by these loop bows 17" even without additional elements serving for the suspension, such as suspension rings 18.

This special configuration brings usage benefits in many respects:

In a swing-like suspension at one point for therapeutic exercises, the two end loop bows 17" can be laid flush one on top of the other in the region of the pocket-like overlap of the center areas 21. In this way, the thus doubled suspension point is more flat and less bulging. This increases the mobility during linear movements and rotary movements. In addition, the fabric of the reclining surface 2 drapes very straight, which facilitates the patients getting onto and off of the hammock. The wear on the hammock at the suspension points can also be reduced in this way, thereby improving its durability.

Stable, secure and sturdy suspension even during intensive use.

In a traditional suspension at two suspension points apart from each other, the hammock opens up invitingly, for example making access and climbing on easier for the elderly.

In a swing-like suspension at two points on the ceiling for therapeutic exercises, the eyelets point away from each other, so that the fabric of the reclining surface drapes very straight, making access and climbing on easier for patients.

In a traditional suspension at two suspension points apart from each other in a hammock stand, the hook on the hammock stand receives the newly designed loop at the same angle, so that an optimal horizontal hanging results, as opposed to the slight rotation which may occur with traditional systems. The whole functions with no additional aids, such as ropes.

On the whole, the hammock according to the invention is decidedly appealing both in terms of its comfort and safety in private use and in public use (such as kindergartens, rest homes) and in terms of the price benefit ratio, especially also for performing therapeutic exercises in practice or at home.

The invention claimed is:

1. A hammock, comprising:

a reclining surface; and two opposite tapering end pieces connected to the reclining surface, each end piece leading to a suspension, wherein the reclining surface of the hammock having the tapering end pieces connected thereto forms an open ellipse with pointed converging ends, wherein the reclining surface consists of a roughly rectangular middle region, which is stitched at both transverse edges to an edge of a corresponding tapering end piece, which leads to a suspension at one of the pointed converging ends of the hammock, and further wherein the reclining surface is laid in several flat folds at both transverse edges, said flat folds defining a plurality of spaced-apart pleats, each abutting against the edges of the tapering end pieces, and stitched to the edges.

2. The hammock as claimed in claim 1, wherein the tapering end pieces are triangular or circular segment shaped end pieces.

3. The hammock as claimed in claim 1, wherein the reclining surface has at least two longitudinal edges and at least one of the two longitudinal edges of the reclining surface is at least partly strengthened.

4. The hammock as claimed in claim 3, wherein at least one of the two longitudinal edges of the reclining surface is at least partly upholstered.

5. The hammock as claimed in claim 4, wherein a broad upholstered margin area is formed for at least a part along one of the two longitudinal edges.

6. The hammock as claimed in claim 1, wherein the tapering end piece suspensions are designed as loop bows arranged on the end pieces.

7. The hammock as claimed in claim 1, wherein loop bows are arranged at the suspensions of the tapering end pieces running in a horizontal plane of the reclining surface.

8. The hammock as claimed in claim 7, wherein the loop bows are an extension of a band, whose two free ends are stitched roughly parallel to each other and with the same top side to tapering ends of the tapering end pieces, whereby the loop bow is configured to spread in a plane of the reclining surface as well as a pocket-like overlap of a center region of the band is produced.

9. The hammock as claimed in claim 1, wherein the tapering end piece suspensions include loop bows and the loop bows are arranged at the end pieces rotated by around 90° vertically to the horizontally extending reclining surface.

10. The hammock as claimed in claim 1, wherein the tapering end piece suspensions each lead to a ring, around which free ends of the tapering end pieces are laid flush and secured.

11. A hammock, comprising:

a middle reclining surface formed of a substantial rectangular shape and having opposite transverse edges; and two opposite tapering end pieces connected to the transverse edges of the middle reclining surface, wherein the middle reclining surface and the tapering end pieces form an open ellipse with pointed converging ends, each of the tapering end pieces defines one of the pointed converging ends of the hammock and is configured to lead to a suspension, each of the transverse edges of the middle reclining surface is stitched to an edge of a corresponding tapering end piece, the edges of the tapering end pieces and the transverse edges are located inward of the ends of the hammock, and the middle reclining surface has several flat folds defining a plurality of spaced-apart pleats and stitched at the transverse edges and abutting against the edges of the tapering end pieces.

* * * * *